US007874367B2

(12) United States Patent
Simmons

(10) Patent No.: US 7,874,367 B2
(45) Date of Patent: Jan. 25, 2011

(54) LOW CLEARANCE DOWNHOLE PUMP

(75) Inventor: Daniel C. Simmons, Pouce Coupe (CA)

(73) Assignees: Pentagon Optimization Services Inc., Red Deer (CA); Angel Energy Inc., Pouce Coupe (CA)

( * ) Notice: Subject to any disclaimer, the term of this patent is extended or adjusted under 35 U.S.C. 154(b) by 203 days.

(21) Appl. No.: 12/121,607

(22) Filed: May 15, 2008

(65) Prior Publication Data

US 2008/0283250 A1 Nov. 20, 2008

Related U.S. Application Data

(60) Provisional application No. 60/938,980, filed on May 18, 2007.

(51) Int. Cl.
*F04B 47/00* (2006.01)
*F04B 53/12* (2006.01)
*E21B 43/00* (2006.01)

(52) U.S. Cl. ..... 166/369; 417/552; 417/53

(58) Field of Classification Search ..... 166/369, 166/370, 372, 379, 383, 386, 68, 68.5, 75.11, 166/84.1, 105, 105.1, 105.2, 105.4, 108; 417/60, 56, 53, 262, 552, 523–526, 546, 417/547, 440, 307
See application file for complete search history.

(56) References Cited

U.S. PATENT DOCUMENTS 2,580,331 A * 12/1951 Teetor ..... 166/68.5
2,950,704 A * 8/1960 Andrews ..... 91/49
3,227,086 A * 1/1966 Haworth, Jr. et al. ..... 417/246

FOREIGN PATENT DOCUMENTS

CA 2453072 A1 5/2004

* cited by examiner

*Primary Examiner*—David J Bagnell
*Assistant Examiner*—James G Sayre
(74) *Attorney, Agent, or Firm*—Oyen Wiggs Green & Mutala LLP

(57) ABSTRACT

A pump has a housing having a top plate and a bottom plate and a shaft slidingly extending through an aperture in the top plate. A piston is connected to the shaft. The piston separates a volume within the housing into a first stage chamber defined in the housing below the piston and a second stage chamber defined in the housing above the piston. A fluid transfer port in the piston is in fluid communication with the second stage chamber and, through a check valve, with the first stage chamber. Another stage check valve allows one-way flow of fluid from a suction area below the bottom plate into the first stage chamber. A pressure control valve may be provided for selectively allowing fluid to flow out of the first stage chamber.

15 Claims, 5 Drawing Sheets

LOW CLEARANCE DOWNHOLE PUMP

CROSS-REFERENCE TO RELATED APPLICATION

This application claims the benefit under 35 U.S.C. §119 of U.S. application No. 60/938,980 filed on 18 May 2007 and entitled LOW CLEARANCE DOWNHOLE PUMP, which is hereby incorporated herein by reference.

TECHNICAL FIELD

The invention relates to pumps, and more particularly to downhole pumps. The invention has particular application to pumps for pumping liquids from oil or gas wells.

BACKGROUND

Oil and gas wells are drilled into geological formations containing oil or natural gas. Some wells have a casing and a smaller production tubing within the casing. This provides two paths for gas to flow to the surface. Gas may flow upward in the space inside the casing and surrounding the tubing or gas may flow inside the tubing. Valves may be provided at the well head to control the flow of gas on each of these paths.

An oil or gas well can become loaded by liquids that accumulate in the well. these liquids can be pumped out of the well to facilitate the free flow of gas and/or oil out of the well.

SUMMARY

This invention relates to pumps. Embodiments of the invention provide pumps suitable for pumping liquids from oil or gas wells. In some embodiments, the pumps are suitable for pumping liquids from 'deep' wells (e.g. wells having depths of about 6000 feet (about 1800 meters) or more).

One aspect of the invention provides downhole pumps comprising a housing and a piston slidably disposed within the housing. The piston divides a volume within the housing into a first stage chamber and a second stage chamber. A first stage check valve is in a first passage connecting the first stage chamber to an intake area below the pump. A second stage check valve is in a second passage connecting the first stage chamber and the second stage chamber. A discharge check valve is in a third passage connecting the second stage chamber and a discharge of the pump. A pressure-operated control valve has an inlet in fluid communication with the first stage chamber and is configured to discharge fluid from the pump in response to a pressure in the first stage chamber exceeding a threshold pressure.

One aspect of the invention provides pumps comprising a housing having a top plate and a bottom plate and a shaft slidingly extending through an aperture defined in the top plate. The shaft defines a discharge port therethrough. A piston is connected to a bottom of the shaft. The piston separates a volume within the housing into a first stage chamber defined in the housing below the piston and a second stage chamber defined in the housing above the piston. A fluid transfer port in the piston is in fluid communication with the second stage chamber. A first stage check valve is arranged to allow a one-way flow of fluid from a suction area below the bottom plate to the first stage chamber. A second stage check valve is arranged to allow a one-way flow of fluid from the first stage chamber to the fluid transfer port and second stage chamber. A discharge check valve is arranged to allow a one-way flow of fluid from the fluid transfer port and second stage chamber to the discharge port. A pressure control valve may be provided for selectively allowing fluid to flow out of the first stage chamber.

One aspect of the invention provides methods for pumping liquid out of a well. The methods comprise placing a pump in a well. The pump comprises a housing and a piston slidably disposed within the housing. The piston divides a volume within the housing into a first stage chamber and a second stage chamber. A first stage check valve is in a first passage connecting the first stage chamber to an intake area below the pump. A second stage check valve is in a second passage connecting the first stage chamber and the second stage chamber. A discharge check valve is in a third passage connecting the second stage chamber and a discharge of the pump. A control valve has an inlet in fluid communication with the first stage chamber. The methods involve raising the piston to draw liquid into the first stage chamber by way of the first stage check valve; and, lowering the piston to transfer liquid from the first stage chamber to the second stage chamber by way of the second stage check valve and raise a pressure within the first stage chamber until the control valve opens.

In addition to the exemplary aspects and embodiments described above, further aspects and embodiments will become apparent by reference to the drawings and by study of the following detailed descriptions.

BRIEF DESCRIPTION OF DRAWINGS

The accompanying drawings illustrate non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
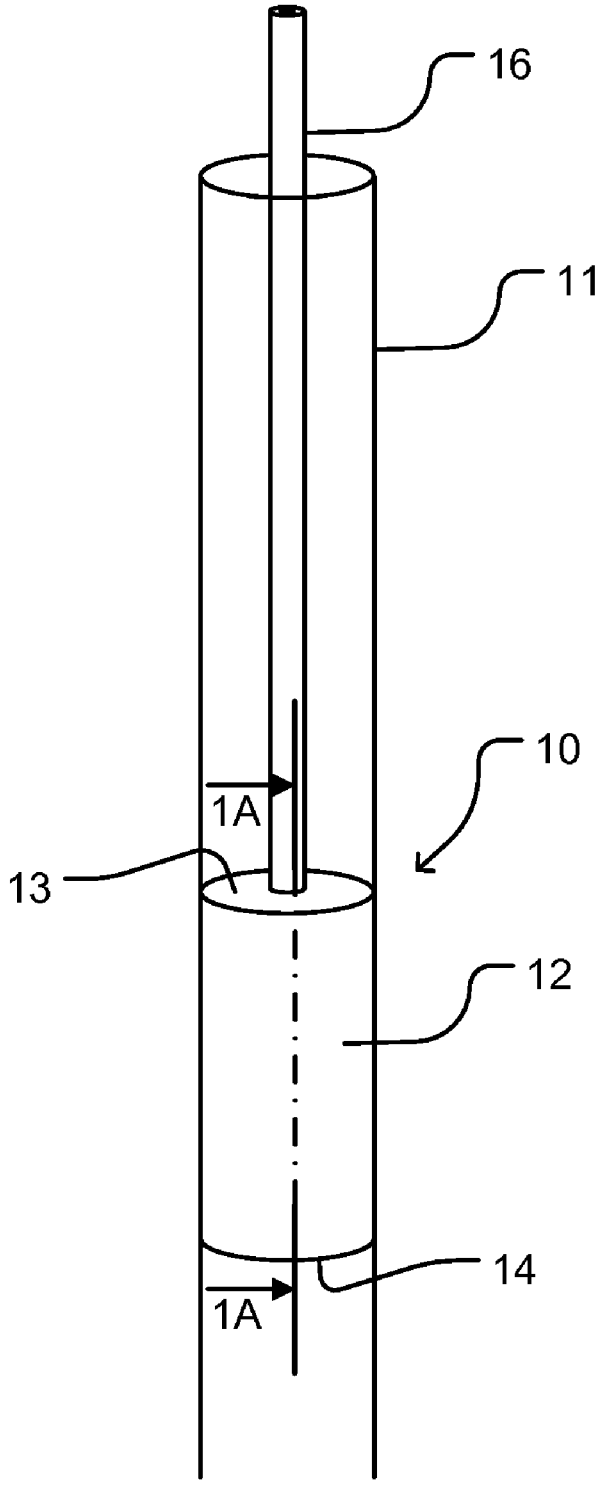
FIG. 1 shows a pump according to one embodiment.
Figure 1A:
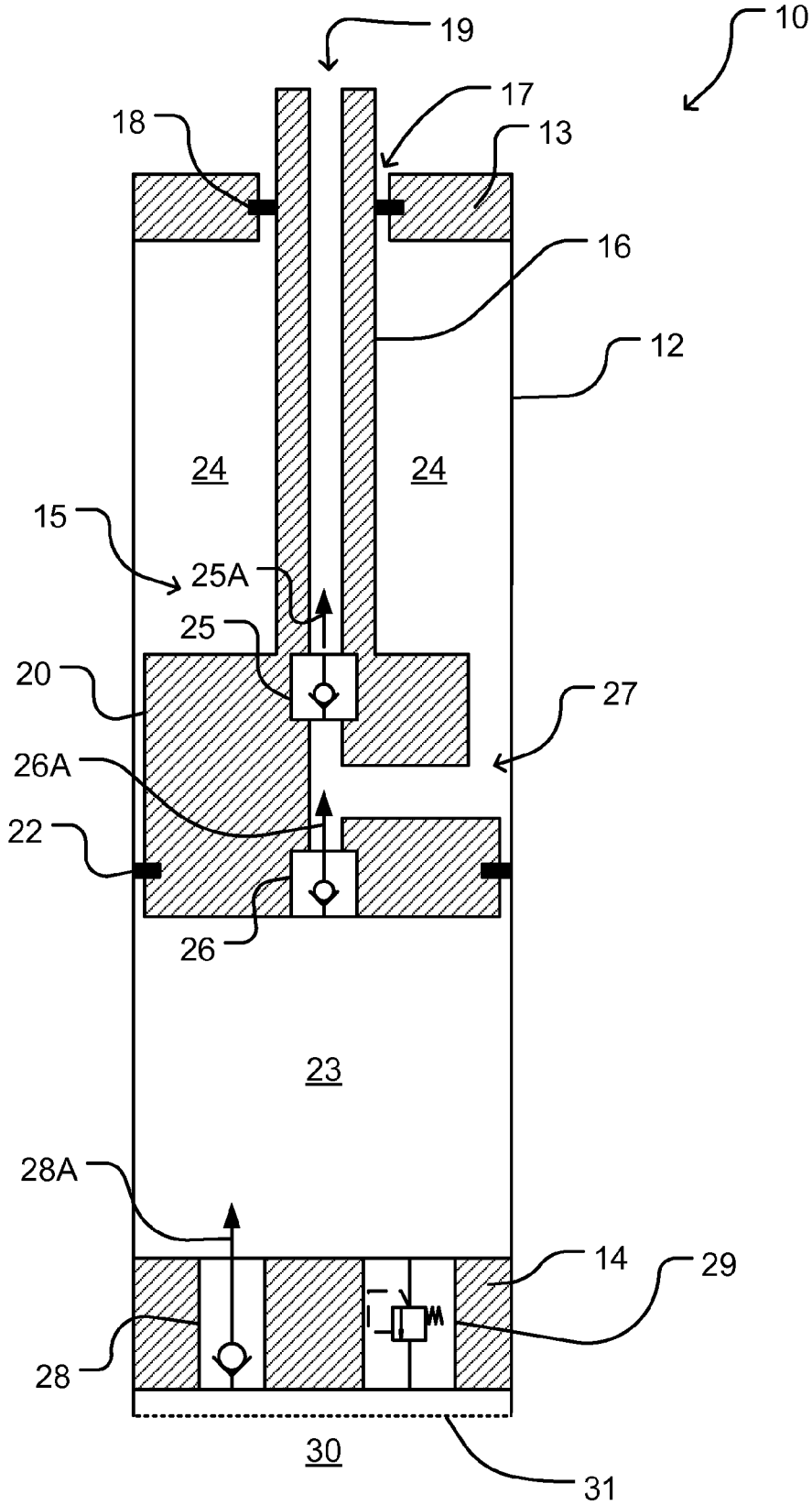
FIG. 1A is a sectional view along line 1A-1A of FIG. 1.

FIGS. 1 and 1A show a pump 10 according to one embodiment. Pump 10 may be positioned down a hole 11. Hole 11 may, for example, comprise a cased well bore or a tube within a well bore. Pump 10 may be located at any depth, but typically in the range of 100 feet (about 30 meters) to 8000 feet (about 2450 meters). In some embodiments, pump 10 is at a depth of about 6000 feet (about 1800 meters) or more. In some embodiments, pump 10 is located within production tubing in a well bore and is operable to pump liquids up the production tubing.

Pump 10 comprises a housing 12 having a top plate 13 and a bottom plate 14. The shape of housing 12 may be selected to correspond with the shape of hole 11. Housing 12 may, for example, comprise a cylindrical shell with a cross section chosen to match the cross section of hole 11.

A shaft 16 is slidingly received in an aperture 17 in top plate 13. A sealing member 18 is supported in aperture 17 to form a seal between top plate 13 and shaft 16. A discharge port 19 is defined through the interior of shaft 16. Alternatively, discharge port 19 could comprise a passage through top plate 13 or another shaft or the like having its own check valve. In some embodiments, shaft 16 and discharge port 19 extend to the surface. Such embodiments may be particularly useful in cases where production tubing in a well bore has leaks. In other embodiments, discharge port 19 may comprise an opening extending through a wall of shaft 16 so that liquids pumped by pump 10 can flow out through the opening into the volume surrounding shaft 16 and up production tubing or other conduit in which pump 10 is located.

A piston 20 is attached to shaft 16. Piston 20 is sized such that only a small clearance gap exists between the outer wall of piston 20 and the inner wall of housing 12. A sealing member 22 is supported on piston 20 to form a seal between housing 12 and piston 20. Piston 20 and seal 22 separate the interior of housing 12 into a first stage chamber 23 and a second stage chamber 24.

A discharge check valve 25 is located in discharge port 19. In the embodiment shown in FIG. 1A, check valve 25 is located in an upper portion of piston 20 at the base of discharge port 19. A second stage check valve 26 is located in a passage that connects first stage chamber 23 and second stage chamber 24. In the embodiment shown in FIG. 1A, second stage check valve 26 is located in a lower portion of piston 20.

A fluid transfer port 27 provides fluid communication between second stage chamber 24 and valves 25 and 26. Discharge check valve 25 allows fluid to flow from second stage chamber 24 into discharge port 19 (via transfer port 27), as indicated by arrow 25A, and prevents fluid from flowing in the reverse direction. Second stage check valve 26 allows fluid to flow from first stage chamber 23 into second stage chamber 24 (via transfer port 27), as indicated by arrow 26A, and prevents fluid from flowing in the reverse direction.

A first stage check valve 28 is located in bottom plate 14. First stage check valve 28 allows fluid to flow from a suction area 30 into first stage chamber 23, as indicated by arrow 28A, and prevents fluid from flowing in the reverse direction. A suction screen 31 is provided between suction area 30 and first stage check valve 28 to prevent solid particles from entering pump 10. A pressure control valve 29 is also located in bottom plate 14. Pressure control valve 29 allows fluid to escape first stage chamber 23 if the pressure in first stage chamber 23 exceeds a threshold pressure, as discussed further below.

Figure 2:
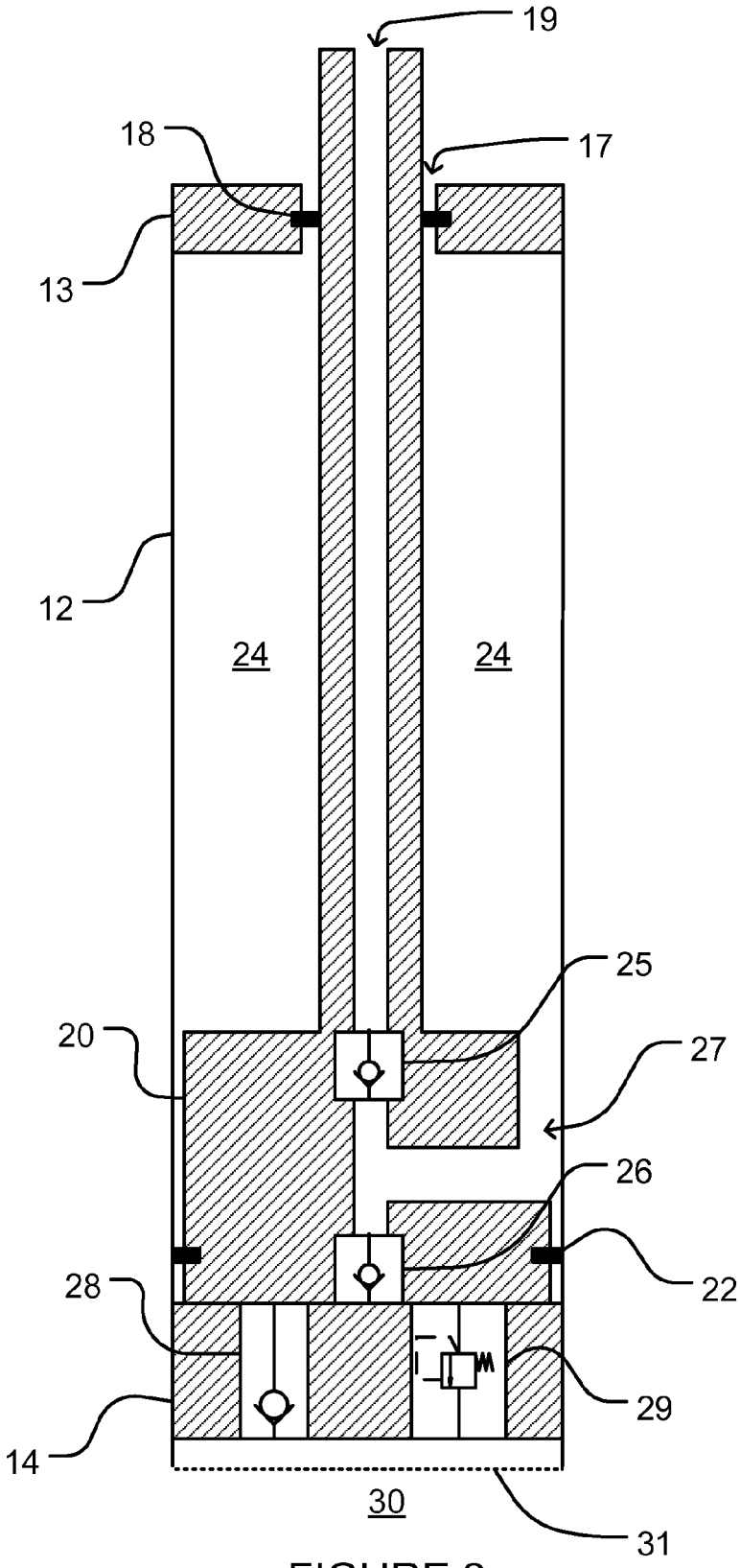
FIG. 2 is a sectional view of the pump of FIG. 1 at the bottom of a pumping cycle.
Figure 3:
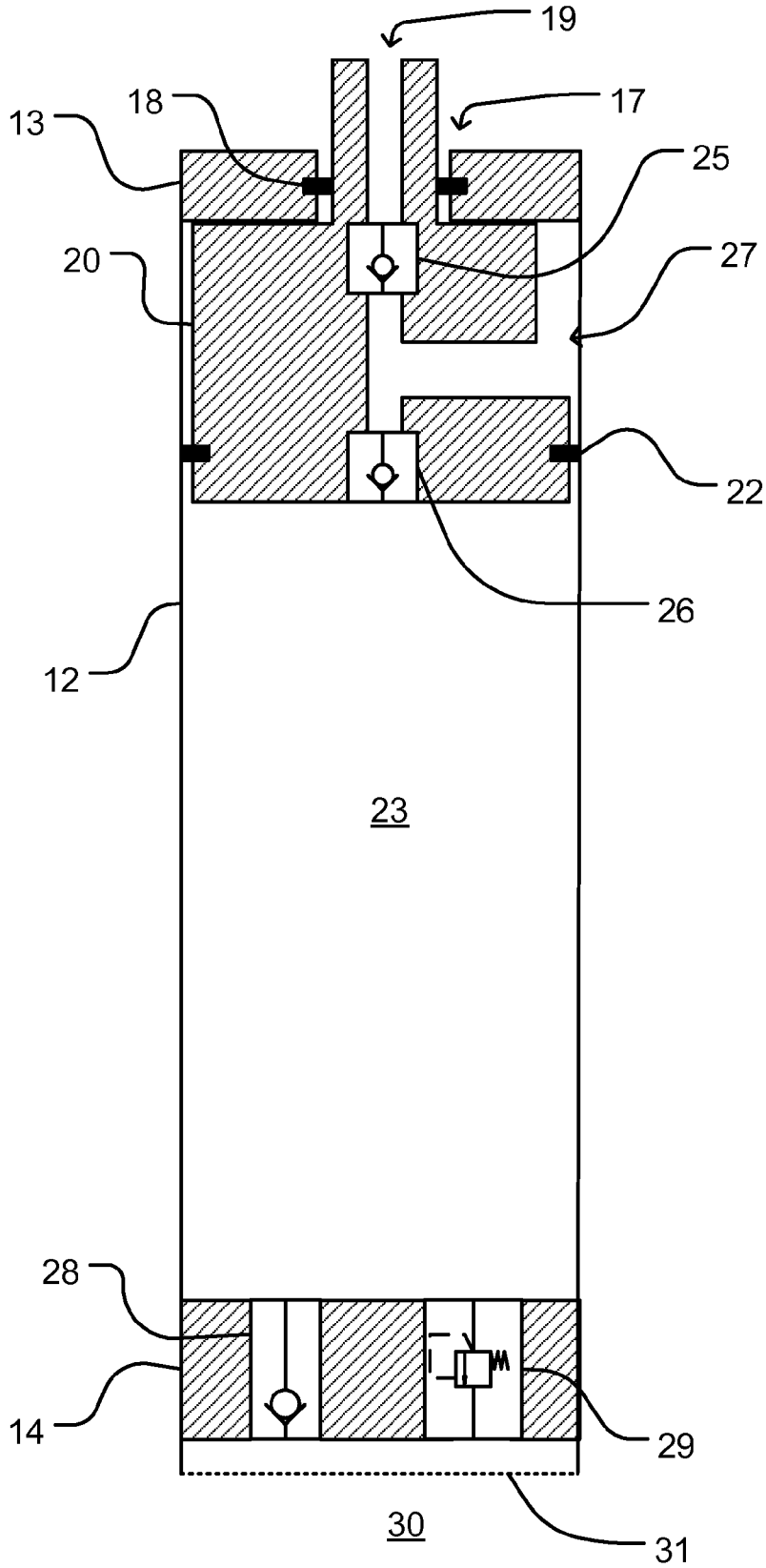
FIG. 3 is a sectional view of the pump of FIG. 1 at the top of a pumping cycle.

In operation, pump 10 is placed in a pumping location down a hole. Piston 20 is reciprocated between a lowered position as shown in FIG. 2, and a raised position, as shown in FIG. 3. Piston 20 may be moved, for example, by raising and lowering shaft 16, which may extend upwards out of the hole to a suitable driving mechanism. The low clearance design of pump 10 allows the bottom of piston 20 to almost abut bottom plate 14 in the lowered position, and the top of piston 20 to almost abut top plate 13 in the raised position. This ensures that little to no fluid remains within pump 10 for more than a single pumping cycle. Providing first stage chamber 23 and second stage chamber 24 that have relatively small minimum volumes eliminates problems experienced with some prior art pumps when gas becomes trapped in the pump, and the gas is repeatedly compressed and decompressed, thus interfering with the flow of liquids.

A pumping cycle comprises an upstroke, wherein piston 20 moves from the lowered position to the raised position, and a downstroke, wherein piston 20 moves from the raised position to the lowered position. During an upstroke, fluid is drawn from suction area 30 through first stage check valve 28 into first stage chamber 23 by the reduced pressure created by the expansion of first stage chamber 23 from a near zero volume (a small gap may exist between sealing member 22 and bottom plate 14), as shown in FIG. 2, to a maximum volume, as shown in FIG. 3. At the same time, fluid in second stage chamber 24 is forced through transfer port 27 and discharge check valve 25 into discharge port 19, and then upwards out of pump 10 by the increased pressure created by the contraction of second stage chamber 24 from a maximum volume, as shown in FIG. 2, to a near zero volume, as shown in FIG. 3.

In some embodiments the minimum volumes of the first and second stage chambers are 2½% or less (in other embodiments, 2% or 1% or ½% or less) of the maximum volumes of the first and second stage chambers. The minimum volumes of the first and second stage chambers may be very small.

During a downstroke, fluid is forced from first stage chamber 23 through second stage check valve 25 and transfer port 27 into second stage chamber 24. Fluid is moved during the downstroke by the simultaneous contraction of first stage chamber 23 from a maximum volume to a near zero volume, and expansion of second stage chamber 24.

Because shaft 16 occupies some of the space in second stage chamber 24, the maximum volume of second stage chamber 24 is less than the maximum volume of first stage chamber 23. The difference in maximum volumes between chambers 23 and 24 depends on the diameter of shaft 16. The presence of shaft 16 in second stage chamber 24 thus causes the volume of second stage chamber 24 to increase at a slower rate than the rate at which the volume of first stage chamber 23 decreases during a downstroke, which assists in compression of any gas in pump 10.

The diameter of shaft 16 may be selected to optimize operation of pump 10 at a desired working depth. In some example embodiments, the diameter of shaft 16 is such that the maximum volume of second stage chamber 24 is approximately 70% (in the range of about 60% to 80% in some embodiments) of the maximum volume of first stage chamber 23.

During a downstroke the swept volume of second stage chamber 24 and first stage chamber 23 become common due to the one way flow of fluid through second stage check valve 26. Shaft 16 passes through second stage chamber 24. The volume occupied by shaft 16 causes the swept volume of second stage chamber 24 to be less than the swept volume of first stage chamber 23. This could cause shaft 16 to go into compression (i.e., a significant downward force would need to be exerted on the top of shaft 16, which could cause buckling) if it were not for pressure control valve 29 being set at a lower pressure than the pump discharge pressure. Preferably shaft 16 is maintained under tension for an entire pumping cycle.

Pressure control valve 29 selectively allows fluid in first stage chamber 23 that will not fit into second stage chamber 24 to exit pump 10. Pressure control valve 29 may be set to allow fluid to escape pump 10 when the pressure in first stage chamber 23 exceeds a predetermined threshold. The predetermined threshold may be selected to be below the final pump discharge pressure. This may allow the hydrostatic pressure of the fluid being discharged to assist in the downstroke of pump 10.

In some embodiments the predetermined threshold pressure is less than 30% or 40% of the discharge pressure. For example, in some embodiments, the predetermined threshold pressure may be about 25% of the discharge pressure. For example, the inventor has determined that the predetermined threshold pressure may be set to 900 psi (about 6 MPa) when the discharge pressure is 3200 psi (about 22 MPa). Pump 10 may be constructed to operate with a discharge pressure sufficient to pump liquid out of a well bore. In an example embodiment a pump 10 has a discharge pressure of 8000 psi (about 55 MPa). In other example embodiments, pump 10 typically operates with a discharge pressure in the range of 20 psi (about ⅛ MPa) to 5000 psi (about 34 MPa).

Pressure control valve 29 may, for example, be positioned to direct the excess fluid to suction area 30. This causes a back-flow of fluid which serves to purge any debris from suction screen 31. In some embodiments, pressure control valve 29 comprises a snap-action valve that opens suddenly. In such embodiments, the sudden opening of pressure control valve 29 can yield a jet of liquid directed at suction screen 31 each time pressure control valve 29 opens. The amount of fluid discharged through pressure control valve 29 during each downstroke of pump 10 may be selected by selecting an appropriate diameter for the portion of shaft 16 that passes through second stage chamber 24.

In some embodiments, a load cell or other scale located at the surface measures the tension on rod 16. One can determine whether the pump is pumping gas or liquid by observing how the rod tension varies with time as the rod is reciprocated up and down to drive the pump. In some embodiments the variation with time of the rod tension is displayed on a chart recorder, computer monitor or other display.

An assembly comprising a suction screen 31 and pressure control valve 29 as described above may be provided on the suction side of other types of pump used in the oil and gas industry. For example, a bottom plate 14 comprising a pressure control valve 29 and a suction screen 31 could be provided on a rod pump or other conventional down hole pump.

In an example embodiment, a pump 10 has a diameter small enough for the pump to be disposed in production tubing in a well. Where the production tubing has a small diameter, for example 2 inches (about 5 cm) the pump 10 may have an overall cylindrical configuration with a diameter small enough to fit within the production tubing. For example, for 2 inch production tubing the pump may have an external diameter of about 1 ¾ inches so that it can fit within the bore of the production tubing. A prototype embodiment has a stroke of 96 inches (about 2½ meters). In some embodiments a ratio of a stroke between the raised and lowered positions and a diameter of the pump is 300:1 or more (400:1 or more in some embodiments).

Figure 4:
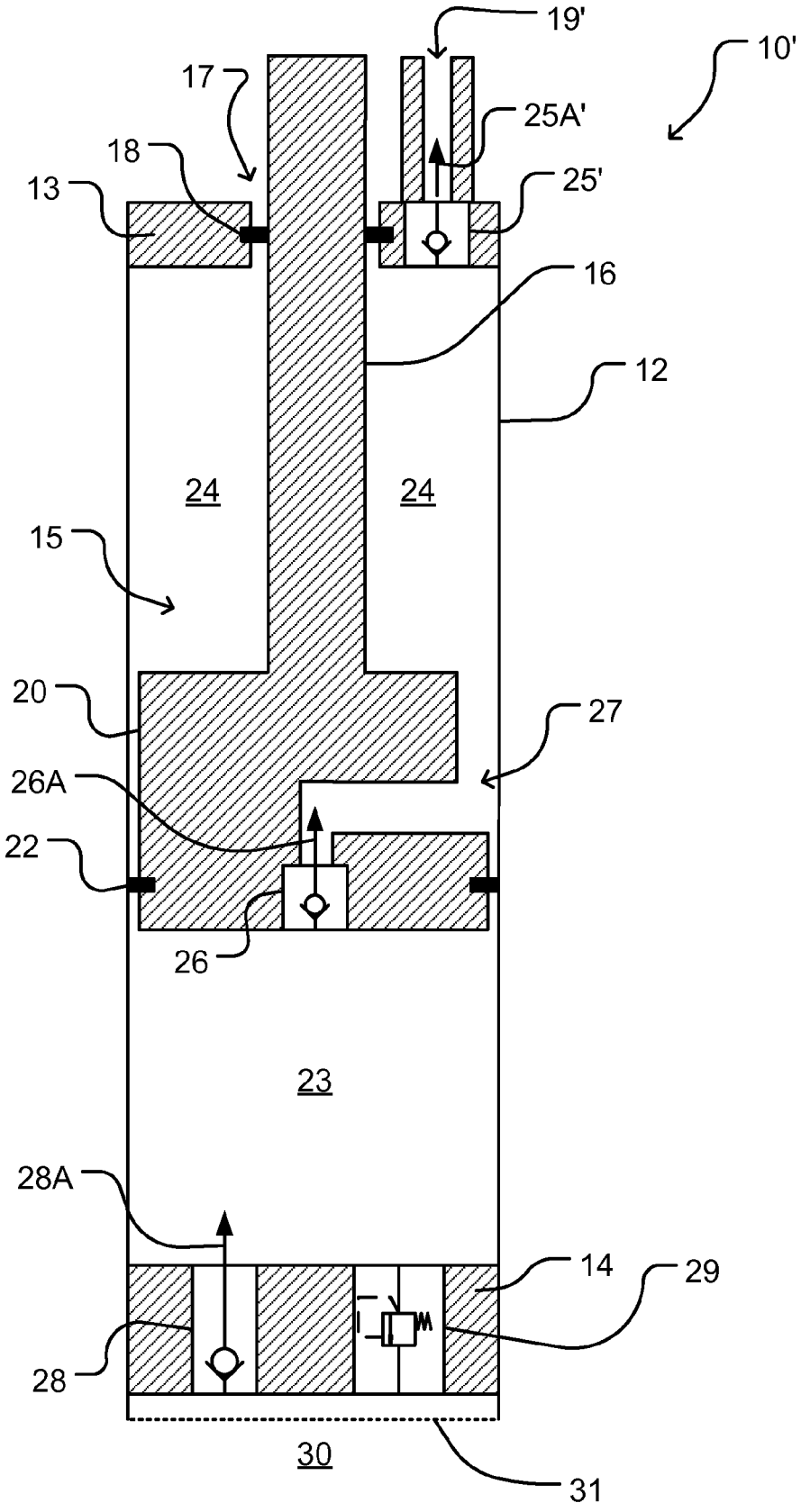
FIG. 4 is a sectional view of a pump according to another embodiment.

FIG. 4 shows a pump 10' according to another embodiment of the invention. Pump 10' is similar to pump 10 discussed above, except that discharge check valve 25' is positioned in top plate 13, and there is no discharge port defined through shaft 16. A separate discharge port 19' may be defined through a separate shaft, tube or the like in fluid communication with discharge check valve 25'. Discharge port 19' may continue up through the well bore or terminate closer to pump 10'. In embodiments where pump 10' is deployed in a hole or well having its own casing, discharge port 19' may not be required. In such embodiments, a discharge check valve could alternatively be provided in a passage providing fluid communication between second stage chamber 24 and the environment above an upper portion of housing 12.

Pumps according to some embodiments have advantages over some prior art pumps. These advantages may include one or more of:

- Suction screen 31 may have relatively small openings since the discharge from pressure control valve 29 may be directed to clean suction screen 31;
- The provision of sealing members 18 and 22 reduces slippage and permits operation at lower stroke rates than might otherwise be required. Operating at slow rates reduces inertia loading on components and reduces wear. Sealing members 18 and 22 may comprise dynamic seals.
- The possibility of gas lock is reduced or eliminated.
- The force on pull shaft 16 on the downstroke is reduced in comparison to some other pump configurations.

It is not mandatory that any or all of these advantages be present in any particular embodiment.

While a number of exemplary aspects and embodiments have been discussed above, those of skill in the art will recognize certain modifications, permutations, additions and sub-combinations thereof. For example:

- First stage check valve 28 and/or pressure control valve 29 could be positioned in a bottom portion of housing 12.
- Pump 10 could be supported from the top or bottom of housing 12 by a well casing.
- Pump 10 could be independently supported on its own tubing string attached to housing 12. This arrangement would be suitable for wells that do not have casing or tubing or that have damaged tubing, or where the tubing ends too far above casing gas perforations to allow effective pump suction. In some such embodiments the pump may screw to the lower end of a section of pipe or tubing.
- An additional sealing member could be formed by a coupling between a lower portion of shaft 16 which is within pump 10 at the bottom of a stroke and an upper portion of shaft 16 which is above pump 10 at the bottom of a stroke. Such a coupling may comprise a threaded connection and have an annular protrusion which abuts the top of top plate 13 around aperture 17 when pump 10 is at the bottom of a stroke, thereby providing an additional seal. In such embodiments, pump 10 may be stopped at the bottom of a stroke and may be left down a hole when not in use. The coupling could reduce the likelihood of fluids entering pump if sealing member 18 fails or leaks over time.

Where a component (e.g. a housing, plate, tube, shaft, valve, seal, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Accordingly, the scope of the invention is to be construed in accordance with the substance defined by the following claims.

What is claimed is:

1. A downhole pump comprising:

a housing;

a piston slidably disposed within the housing, the piston dividing a volume within the housing into a first stage chamber and a second stage chamber;

a first stage check valve in a first passage connecting the first stage chamber to an intake area below the pump;

a second stage check valve in a second passage connecting the first stage chamber and the second stage chamber wherein the second passage passes through the piston and the second stage check valve is carried by the piston;

a discharge check valve in a third passage connecting the second stage chamber and a discharge of the pump;

a pressure-operated control valve having an inlet in fluid communication with the first stage chamber and configured to discharge fluid from the pump in response to a pressure in the first stage chamber exceeding a threshold pressure;

a shaft coupled between the piston and a reciprocating driving mechanism above the pump wherein the shaft passes through the second stage chamber; and a transfer port defined in the piston, the transfer port having a first end opening into the second stage chamber wherein an outlet of the second stage check valve discharges into the transfer port and an inlet of the discharge check valve draws from the transfer port.

2. A downhole pump according to claim 1 wherein the control valve is connected between the first stage chamber and the intake area.

3. A downhole pump according to claim 2 comprising a screen in the intake area wherein an outlet from the control valve is directed toward the screen.

4. A downhole pump according to claim 2 wherein the control valve is configured to open at a pressure that is 30% or less of a discharge pressure of the pump.

5. A downhole pump according to claim 3 wherein:

the piston is movable between a lowered position wherein the first stage chamber has a first minimum volume and the second stage chamber has a second maximum volume and a raised position wherein the first stage chamber has a first maximum volume and the second stage chamber has a second minimum volume; and a first difference between the first maximum volume and the first minimum volume exceeds a second difference between the second maximum volume and the second minimum volume.

6. A downhole pump according to claim 5 wherein the first difference exceeds the second difference by at least ¼ of the second difference.

7. A downhole pump according to claim 6 wherein the second maximum volume is about 70% of the first maximum volume.

8. A downhole pump according to claim 6 wherein the first and second minimum volumes are 2½% or less of the first and second maximum volumes respectively.

9. A downhole pump according to claim 8 wherein a ratio of a stroke between the raised and lowered positions and a diameter of the pump is 300:1 or more.

10. A downhole pump according to claim 1 comprising a longitudinally-extending passage in at least a portion of the shaft above the piston wherein the discharge check valve is connected to discharge fluid into the longitudinally-extending passage.

11. A downhole pump according to claim 10 wherein the longitudinally-extending passage extends from the piston to an above-ground location.

12. A downhole pump according to claim 1 wherein the housing comprises a bottom plate and the first stage check valve and the control valve are supported on the bottom plate.

13. A downhole pump according to claim 1 comprising a dynamic seal carried by the piston and sealing against a bore within the housing.

14. A downhole pump according to claim 13 comprising a dynamic seal supported on the housing and sealing against the shaft.

15. A downhole pump according to claim 1 wherein a diameter of the pump is 5 cm or less.

* * * * *